US009309696B2

(12) United States Patent
Friese et al.

(10) Patent No.: US 9,309,696 B2
(45) Date of Patent: Apr. 12, 2016

(54) DOOR LOCK SYSTEM AND METHOD

(75) Inventors: Donald E. Friese, Los Angeles, CA (US); Gary Sprague, Los Angeles, CA (US)

(73) Assignee: C.R. LAURENCE COMPANY, INC., Los Angeles, CA (US)

( * ) Notice: Subject to any disclaimer, the term of this patent is extended or adjusted under 35 U.S.C. 154(b) by 759 days.

(21) Appl. No.: 11/849,970

(22) Filed: Sep. 4, 2007

(65) Prior Publication Data

US 2008/0148790 A1 Jun. 26, 2008

Related U.S. Application Data

(60) Provisional application No. 60/876,711, filed on Dec. 22, 2006.

(51) Int. Cl.

| | |
|---|---|
| ***E05B 65/08*** | (2006.01) |
| ***E05B 53/00*** | (2006.01) |
| ***E05D 15/06*** | (2006.01) |
| *E05B 65/00* | (2006.01) |
| *E05C 7/04* | (2006.01) |

(52) U.S. Cl.

CPC ..... *E05B 53/00* (2013.01); *E05D 15/0604* (2013.01); *E05B 65/0025* (2013.01); *E05C 7/04* (2013.01); *E05D 15/0608* (2013.01); *E05Y 2900/142* (2013.01); *Y10T 70/5155* (2015.04); *Y10T 70/5199* (2015.04)

(58) Field of Classification Search

USPC ..... 70/95, 99, 100, 134, 96–98, 103, 108, 70/113, 118; 292/138

See application file for complete search history.

(56) References Cited

U.S. PATENT DOCUMENTS

| | | | | | |
|---|---|---|---|---|---|
| 449,677 | A | | 4/1891 | Higbee | |
| 1,049,529 | A | | 1/1913 | Perry | |
| 1,294,949 | A | | 2/1919 | Roberts | |
| 1,341,038 | A | | 5/1920 | Bickel | |
| 1,637,127 | A | | 7/1927 | Ornoski | |
| 2,284,409 | A | | 5/1942 | Erath | |
| 2,735,706 | A | | 2/1956 | Pelcin | |
| 2,886,960 | A | | 5/1959 | Willett et al. | |
| 3,112,635 | A | * | 12/1963 | Van Harn et al. | 70/100 |
| 3,633,389 | A | | 1/1972 | Horgan, Jr. | |
| 3,670,537 | A | | 6/1972 | Horgan, Jr. | |
| 3,680,901 | A | | 8/1972 | Biebuyck | |
| 3,683,555 | A | | 8/1972 | Kuniansky | |
| 3,863,470 | A | * | 2/1975 | Imer | 70/100 |
| 3,964,281 | A | * | 6/1976 | Shipman | 70/120 |
| 4,315,648 | A | * | 2/1982 | Labelle | 70/100 |
| 4,362,328 | A | | 12/1982 | Tacheny et al. | |
| 4,461,160 | A | * | 7/1984 | Van Gompel | 70/100 |
| 4,694,669 | A | * | 9/1987 | Schwalb | 70/100 |
| 4,880,261 | A | | 11/1989 | Bisbing | |
| 4,891,921 | A | * | 1/1990 | Governale | 70/95 |
| 4,892,338 | A | | 1/1990 | Weinerman et al. | |
| 4,944,169 | A | * | 7/1990 | Labelle et al. | 70/100 |
| 4,951,486 | A | | 8/1990 | Braun et al. | |
| 5,058,937 | A | | 10/1991 | Miehe et al. | |
| 5,076,620 | A | | 12/1991 | Campbell et al. | |

(Continued)

*Primary Examiner* — Christopher Boswell

(74) *Attorney, Agent, or Firm* — Cislo & Thomas, LLP

(57) ABSTRACT

A door panel lock system for a door panel assembly. The door panel lock system is incorporated into a cutout in a door panel of the door panel assembly. The lock system includes a lock mechanism that is coupled to a floor bolt assembly by a connecting member, and a cover that is coupled to the door panel and covers a portion of the cutout and the connecting member.

24 Claims, 11 Drawing Sheets

(56) References Cited

U.S. PATENT DOCUMENTS

| | | | | | |
|---|---|---|---|---|---|
| 5,290,077 | A | * | 3/1994 | Fleming | 70/108 |
| 5,375,894 | A | | 12/1994 | Schlack | |
| 5,498,038 | A | | 3/1996 | Simon et al. | |
| 5,561,994 | A | * | 10/1996 | Smith et al. | 70/95 |
| 5,586,795 | A | | 12/1996 | Sasaki | |
| 5,595,076 | A | | 1/1997 | Weinerman et al. | |
| 5,782,114 | A | | 7/1998 | Zeus et al. | |
| 5,806,353 | A | | 9/1998 | Pages | |
| 5,911,763 | A | | 6/1999 | Quesada | |
| 6,006,560 | A | | 12/1999 | DeVries | |
| 6,116,662 | A | | 9/2000 | Johnson | |
| 6,196,034 | B1 | * | 3/2001 | Diebold et al. | 70/95 |
| 6,375,244 | B1 | | 4/2002 | Smeltzer | |
| 6,490,895 | B1 | | 12/2002 | Weinerman et al. | |
| 6,592,155 | B1 | | 7/2003 | Lemley et al. | |
| 6,758,503 | B2 | | 7/2004 | Sadler | |
| 7,013,687 | B2 | | 3/2006 | Shedd et al. | |
| 7,377,076 | B2 | * | 5/2008 | Shedd | 70/108 |

* cited by examiner

DOOR LOCK SYSTEM AND METHOD

CROSS-REFERENCE TO RELATED APPLICATIONS

This application claims priority to U.S. Provisional Patent Application Ser. No. 60/876,711, filed Dec. 22, 2006, the disclosure of which is hereby incorporated in its entirety herein by reference.

FIELD OF THE INVENTION

The present invention relates to a door or panel lock system.

BACKGROUND OF THE INVENTION

Doors are configured in many different ways, but no matter the door configuration, a lock mechanism that securely holds the door in place frequently is desired. Swinging doors often are used for building or room entrances. Oftentimes when multiple doors are utilized unique locking challenges are presented. For example, opposed swinging doors often are required to lock to each other rather than a stationary frame or jam, the doors often require a more robust and unique locking mechanism.

Movable wall panels also present challenges. Movable wall panels are used to divide an area into two or more regions. For example, movable wall panels are employed in schools, hotels, and convention centers to divide a large room into two or more smaller rooms. Another common use of movable wall panels is the formation of individual shop fronts within a mall. Clear glass panels are typically stored during business hours to produce a wide-open storefront, and are disposed in front of the storefront during off-business hours to permit the viewing of merchandise.

Movable wall panel systems typically include several components, such as wall panels, trolleys coupled to the wall panels, and tracks within which the trolleys can slide and displace the wall panels. The wall panels often are large planar structures that may be freestanding or attached to one another end-to-end. Many modern applications of wall panel systems utilize freestanding wall panels in order to allow greater versatility over systems using wall panels that are attached end-to-end.

Lock mechanisms often are included on swinging doors and movable wall panels that allow at least some of the doors or panels to be coupled to the floor. Various lock mechanisms have been developed for directly coupling a door to a floor. For example, some doors utilize floor bolts that are actuated at the bottom of the door, such as with a pedal or a lock cylinder mounted on the door adjacent the floor. Such floor bolts potentially can bind or jam and a user is required to bend or squat down to adjust or release the bolt, which is inconvenient, uncomfortable and dirty.

In another example, U.S. Pat. No. 2,284,409 relates to a bolt structure device that allows a lower corner of a door to be latched to a floor. The device is attached to a glass panel having a recess that extends over the lower corner of the panel from a first face to a lower face of the panel. A shoe portion, or covering, is used to cover the recess and to provide a mount for the bolt structure. The bolt structure includes a lever that is coupled to a sliding bolt so that rotation of the lever causes the bolt to slide vertically into or out of locked engagement with a socket provided in the floor. The lever is provided adjacent the sliding bolt at the lower corner of the door on an engagement surface of the door. A deficiency of this arrangement is that a user is required to bend down to activate the bolt structure. In addition, in installations utilizing two swinging doors, only one door can utilize the bolt structure because after the first door is locked in place a bolt structure on the second door becomes inaccessible when the second door is closed.

Attempts have been made to relocate the activation mechanism for vertical bolts to more convenient locations (i.e., further up the door from the floor). For example, various handles and frames incorporating vertical bolts have been utilized. For example, U.S. Pat. No. 3,670,537 relates to a lock for a glass door that utilizes a pair of housings mounted to opposite surfaces of the door panel and spaced from an engagement edge of the door panel. The housings are located on opposite sides of the glass panel and bolted together so that a portion of the glass panel is clamped there between. The first housing provides a means for mounting a lock cylinder and the second housing is a rigid channel that contains the vertical bolt lock mechanism and a lock cylinder. Although the mechanism provides access to a user, in that the pair of housings is mounted to opposite surfaces of the door panel, the effective thickness of the panel substantially is increased. In addition, because the housings extend away from the door panel, they are more susceptible to damage.

In similar devices, a vertical bolt is integrated into an elongate handle that extends at least from a standard lock height to the floor. The vertical bolt extends through a bore extending the entire length of the handle and the handle is spaced from the door. Because the bolt is integrated into a handle, the effective thickness of the door is increased due to the spacing of the handle away from the door panel. A further disadvantage is that handles with integrated vertical bolts are expensive to manufacture.

Some known arrangements provide vertical bolts but those attempts have provided additional disadvantages. For example, U.S. Pat. Nos. 4,892,338 and 6,490,895 to Weinerman et al. describe a flush mountable operating mechanism, e.g., a paddle handle, that activates a pair of vertical bolts by applying tension to a pair of elongate members, e.g., cables or rods. The elongate members are spaced from the engagement edge of the door. A disadvantage of such a system is that the door panel is hollow or alternatively bores are created through a solid core door to provide a path for the tension members. A further disadvantage is that when a transparent door panel is desired the tension members reduce the transparent surface area of the panel.

Accordingly, there is a need for a door lock system that includes a floor bolt, and does not require bending or direct engagement to operate.

There is also a need for a door lock system that does not increase the effective thickness of the door panel or minimally does so.

There is a further need for a door lock system that simplifies manufacture of a door panel assembly.

There is yet a further need for a door lock system that reduces impairment of the transparent surface area of transparent doors.

SUMMARY OF THE INVENTION

The present invention alleviates to a great extent the disadvantages of known door lock systems by providing a door lock system and related method of use, in which one or more door panel assemblies are provided with a door lock system that includes a floor bolt. The door lock system is incorporated into a cutout in the wall panel and is concealed.

In an embodiment, a door panel assembly includes a door panel having a cutout of any profile, such as a stepped profile, wherein the cutout includes a first portion and a second portion. The first portion is wider than the second portion and a locking mechanism is coupled to the wall panel in the first portion. The assembly also includes a floor bolt configured to translate between a locked position in which the floor bolt extends from a surface of the door panel assembly, such as a bottom surface, and an unlocked position in which the floor bolt is retracted. A connecting member extends between the locking mechanism and the floor bolt and is at least partially disposed in the second portion of the stepped cutout. A connecting member cover is coupled to the door panel and covers the connecting member.

In another embodiment, a swinging door assembly includes a pivot assembly, and a door panel assembly including a door panel including a cutout, such as for example a stepped cutout. A locking mechanism is coupled to the door panel in a first portion of the stepped cutout. A floor bolt is also included and is configured to translate vertically between a locked position in which the floor bolt extends from a surface of the wall panel assembly and an unlocked position. A connecting member extends between the locking mechanism and the floor bolt and is disposed in a second portion of the stepped cutout. A connecting member cover is coupled to the door panel and covers the connecting member. The door panel assembly is pivotally coupled to the pivot assembly so that it is configured to pivot between an open position and a closed position.

In a still further embodiment, a door lock system is incorporated into a wall panel system that includes an elongate track, a plurality of trolleys each movably coupled to the track, and a plurality of wall panel assemblies. Each wall panel assembly includes a wall panel that has a stepped cutout. A locking mechanism is coupled to the wall panel in a first portion of the stepped cutout. A floor bolt is also included in the wall panel assembly and is configured to translate vertically between a locked position in which the floor bolt extends from a bottom surface of the wall panel assembly and an unlocked position in which the floor bolt is retracted. A connecting member extends between the locking mechanism and the floor bolt assembly and is disposed in a second portion of the stepped cutout. A connecting member cover is coupled to the wall panel and covers the connecting member. Each wall panel is coupled to at least one trolley.

These and other features and advantages of the present invention will be appreciated from a review of the following detailed description of the invention, along with the accompanying figures in which like reference numerals refer to like parts throughout.

DETAILED DESCRIPTION OF THE INVENTION

Figure 1:
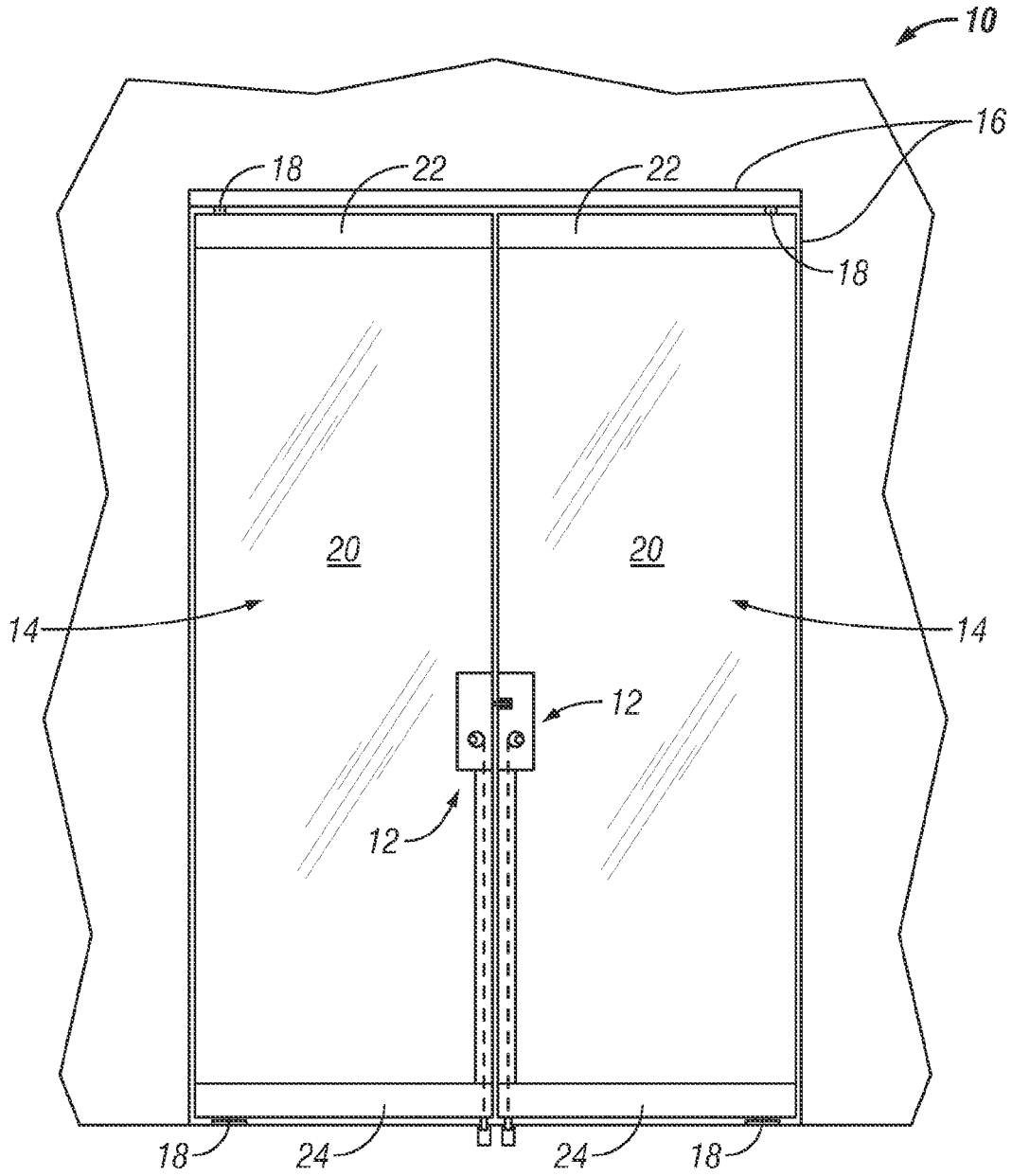
FIG. 1 is a side view of an exemplary embodiment of a swinging door.

In the following paragraphs, the present invention will be described in detail by way of example with reference to the accompanying drawings. Throughout this description, the preferred embodiments and examples shown should be considered as exemplars, rather than as limitations on the present invention. As used herein, the "present invention" refers to any one of the embodiments of the invention described herein, and any equivalents. Furthermore, reference to various aspects of the invention throughout this document does not mean that all claimed embodiments or methods must include the referenced aspects.

Referring to FIGS. 1-7, an embodiment of a swinging door system 10 including a pair of door panel lock assemblies 12 will be described. Swinging door system 10 generally includes a pair of door panel assemblies 14 coupled to a door frame 16. Each of the door panel assemblies 14 is coupled to door frame 16 through a pivot assembly 18 so that each door panel assembly is able to swing between an open position and a closed position (as shown).

Each door panel assembly 14 includes a door panel 20, an upper rail 22, a lower rail and door lock assembly 12. Door panel 20 is constructed so that it forms a partition when suspended within door frame 16, as will be readily appreciated. Door panel 20 may be constructed from any material such as glass, wood, metal, composites or any combination thereof. In a preferred embodiment, door panel 20 is constructed of tempered glass so that it provides a transparent physical barrier, which may be especially desirable for a store front application.

An upper portion of door panel 20 extends into a channel included in upper rail 22. Upper rail 22 is mechanically coupled, such as by mechanical clamping or bonding, to door panel 20 so that door panel assembly 14 may be suspended between a header of door frame 16 and a floor. For example, the rail may be bonded to wall panel 20 using expansion cement, or coupled to wall panel 20 by a mechanical clamp or by suspending the wall panel from the rail using mechanical hardware and thru holes.

Similarly, a lower portion of door panel 20 extends into a channel included in lower rail 24. Lower rail 24 is also mechanically coupled, i.e., by mechanical clamping or bonding, to door panel 20 so that door panel 20 and lower rail 24 may be suspended within door frame 16. In the present embodiment, lower rail 24 is suspended but it should be appreciated that a hinge or rollers may be coupled to lower rail 24. Although upper rail 22 and lower rail 24 are shown extending the full width of door panel 20 it should be appreciated that patch rails, i.e., rails extending along only a portion of door panel 20 may be used.

Upper and lower rails, 22 and 24, each include a pivot mounting feature that is used to mount each of the rails to pivot assembly 18. For example, pivot assembly may include a bracket with an extending rod and pivot mounting feature may be a blind, or through, hole included in the corresponding rail that receives the extending rod. Alternatively pivot assembly 18 may be one or more hinges that are clamped to the rails or the door panel. It should be appreciated that any pivot assembly known in the art may be utilized.

Figure 2:
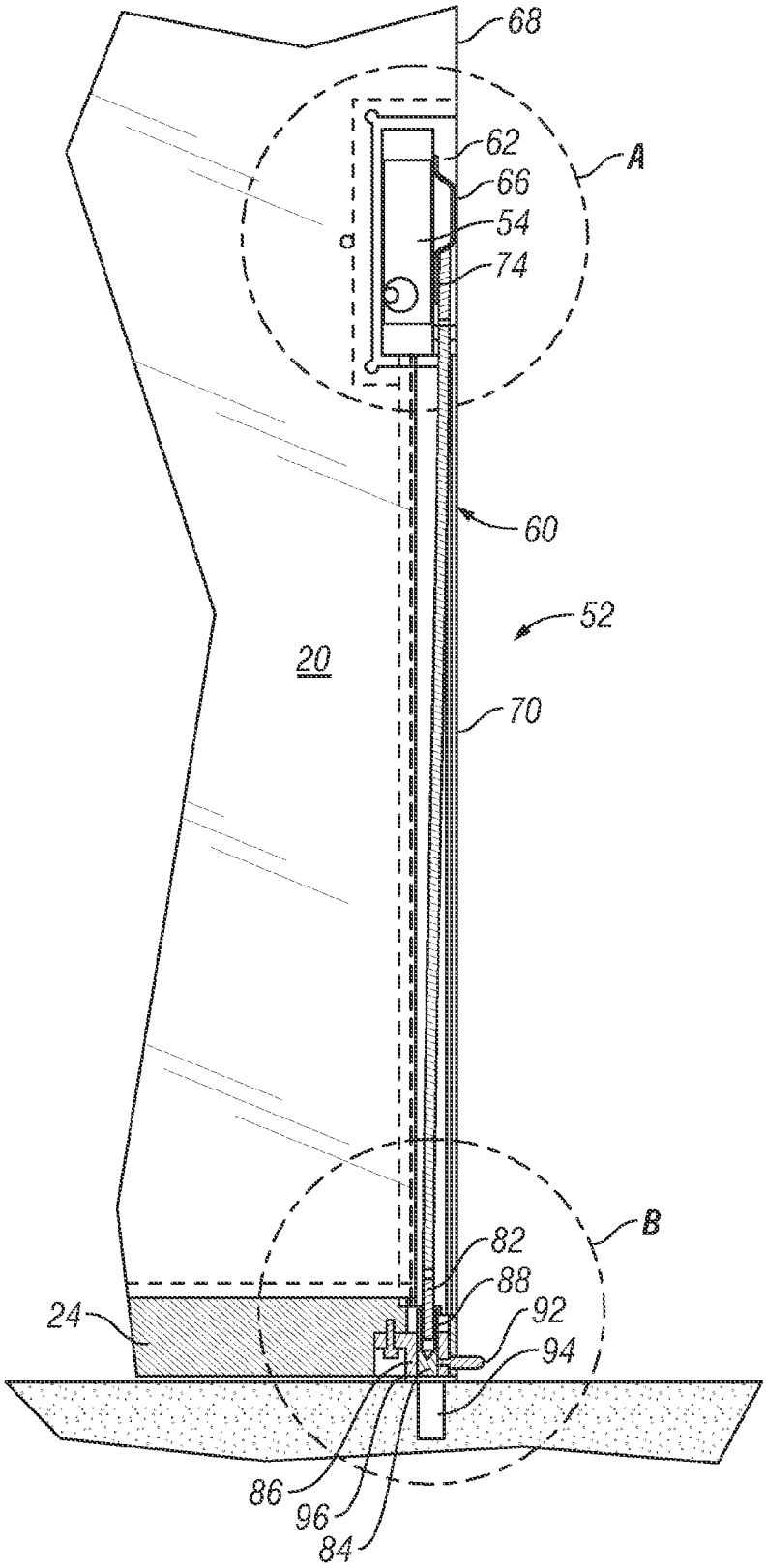
FIG. 2 is a partial cross-sectional view of a door panel assembly including a door lock assembly in accordance with the present invention.

Each wall panel assembly 14 includes at least one panel lock assembly 12 so that it may be locked in position when it is placed in its predetermined closed position. Referring to FIG. 2, panel lock assembly 12 is located within a cutout 52 provided at the edge of wall panel 20. Locating panel lock assembly 12 within cutout 52 allows it to be spaced the greatest distance from the pivot assembly 18 while allowing panel lock assembly 12 to be concealed within door panel assembly 14. The concealment of door panel lock assembly 12 prevents tampering, allows the thickness of door panel assembly 14 to be minimized and provides aesthetic appeal by reducing the surface area of door panel 20 dedicated to door panel lock assembly 12.

Figure 3:
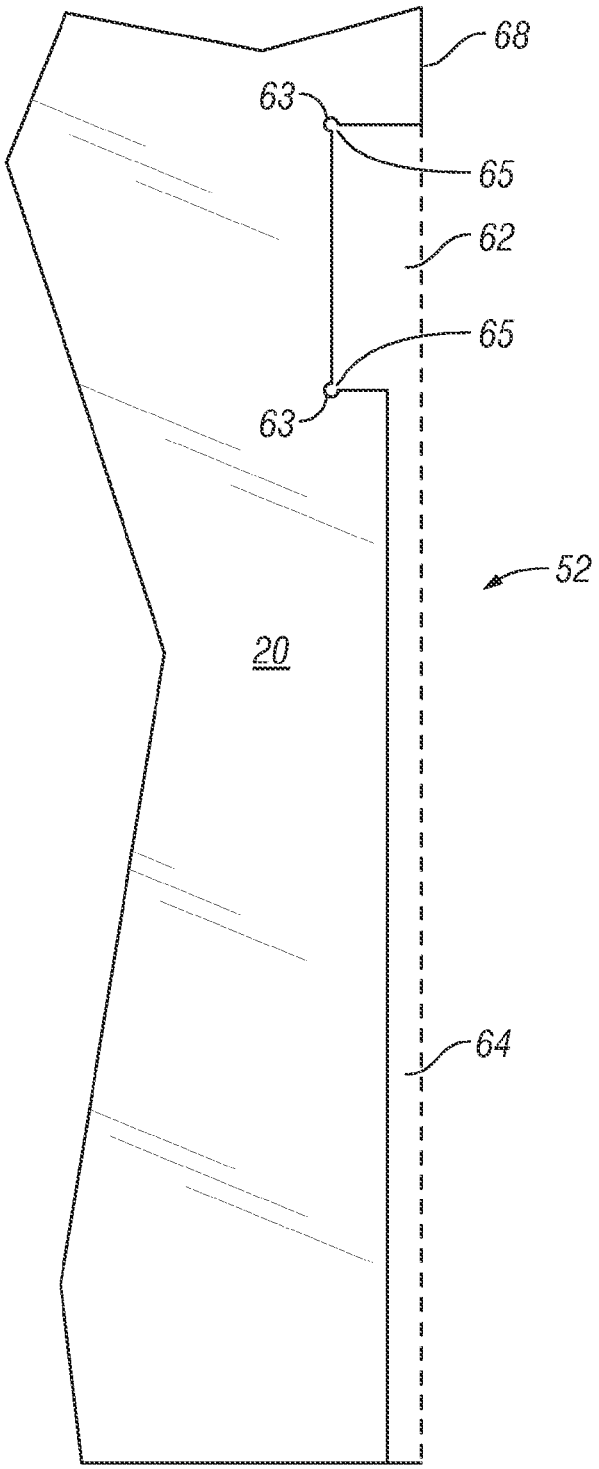
FIG. 3 is a cross-sectional side view of an exemplary door panel in accordance with the present invention.
Figure 4:
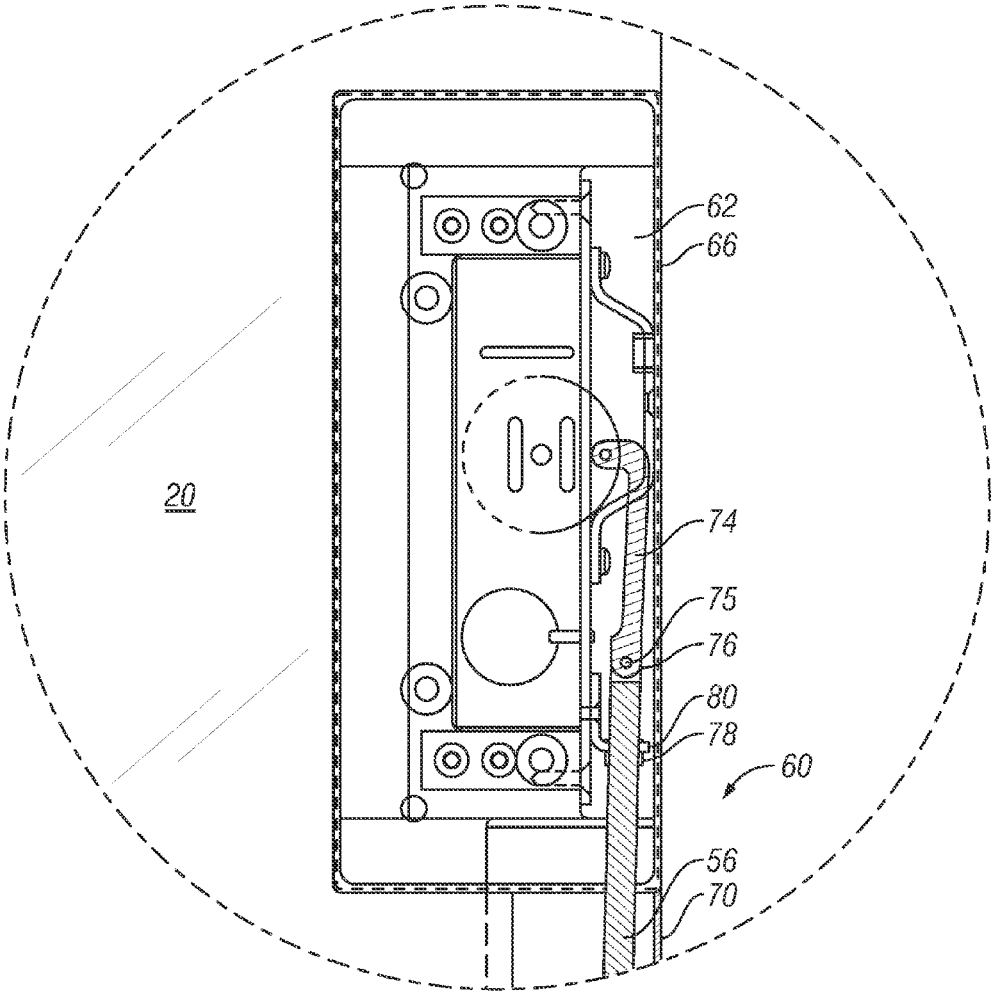
FIG. 4 is a detail view of a portion A of the door lock assembly of FIG. 1.

Referring to FIG. 3, cutout 52 of door panel 20 will be described. Cutout 52 forms a stepped recess located along a vertical edge of door panel 20. Cutout 52 includes two portions 62 and 64. The first portion, lock mechanism portion 62, allows main lock mechanism 54 to be mounted to door panel 20 so that an engagement edge 66 of lock mechanism 54 is flush with an engagement edge 68 of door panel 20. The second portion, connecting rod portion 64, provides clearance for a connecting rod cover 60 to be mounted to door panel 20 so that an engagement edge 70 of cover 60 is also flush with engagement edge 68 of door panel 20 and engagement edge 66 of lock mechanism 54. As will be described in greater detail below, connecting rod portion 64 provides a space so that when connecting rod cover 60 is coupled to door panel 20 it creates a lumen for a connecting rod 56. Connecting rod 56 is narrower than main lock mechanism 54 so connecting rod portion 64 of cutout 56 may be narrower than lock mechanism portion 62. Preferably, the width of connecting rod portion 64 is minimized so that the reduction in surface area of door panel 20 for door panel lock assembly 12 is minimized. Furthermore, the edge of door panel 20 along connecting rod portion 64 may be concave to further conceal connecting rod 56 while increasing the surface area of door panel 20.

Cutout 52 may also include stress relief features 63 located at interior corners of cutout 52. In the present embodiment, lock mechanism portion 62 includes two interior corners 65. Stress relief features 63 are through holes drilled through door panel 20 at interior corners 65 to increase the effective radius of the corners, thereby reducing the likelihood of crack formation.

Referring again to FIG. 2, door panel lock assembly 12 generally includes main lock mechanism 54 that is mechanically coupled to a floor bolt assembly 58 via a connecting member (e.g., connecting rod 56), and a cover (e.g., connecting rod cover 60). Now referring to FIGS. 2, 4 and 6, lock mechanism 54 is installed in lock mechanism portion 62 of cutout 52 and is supported by a center lock housing 72. Lock mechanism 54 is preferably keyed, but it should be appreciated that it may also include any lock known in the art, such as a standard lock or thumb turn. It should be appreciated that lock mechanism 54 may include a side-lock, as shown, if desired.

Activation of lock mechanism 54 results in vertical translation of connecting rod 56, which, as will be described below, activates floor bolt assembly 58 and locks or unlocks door panel assembly 14 by extending or retracting the floor bolt. Lock mechanism 54 is preferably mounted on door panel 20 at a height that does not require an average user to bend to activate panel lock assembly. In particular, lock mechanism 54 includes a rotating actuator 55 that rotates in response to a user turning a key or thumb tab. A first end of a transfer arm 74 is pivotally connected to rotating actuator 55 so that it moves along an arc defined by the rotation of rotating actuator.

Transfer arm 74 extends out of lock mechanism 54 and a second end of transfer arm 74 is pivotally connected to connecting rod 56. As mentioned above, lock mechanism 54 and transfer arm 74 are configured so that rotational motion of rotating actuator 55 is partially transformed into vertical translational motion of transfer arm 74. Transfer arm 74 includes a tab 76 that is configured to pivotally mount with connecting rod 56 at an upper end of connecting rod 56. Tab 76 is inserted into a channel of connecting rod 56 and a pin 75, or other fastener, extends across the interface to form the rotatable connection.

A connecting rod guide 78 extends from lock mechanism 54 so that translation of transfer arm 74 is efficiently transmitted to connecting rod 56. Guide 78 is generally L-shaped and includes an aperture 80. The size of aperture 80 is selected so that connecting rod 56 is free to slide within aperture 80.

Connecting rod 56 is a rigid elongate connecting member that extends from transfer arm 74 toward floor bolt assembly 58. Connecting rod 56 may be any elongate rod that provides sufficient stiffness to transmit translation of transfer arm 74 to floor bolt assembly 58. Connecting rod 56 may be constructed from any desired material, such as, for example, steel, composites, aluminum or other nonferrous metals. Preferably, connecting rod 56 is constructed from 300 series stainless steel.

It should be appreciated that a cable and spring system may be used as an alternative to a rigid elongate rod. For example, a spring may be used to bias the floor bolt assembly into a locked position and the lock mechanism may apply tension to the cable to counteract the spring and to place the floor bolt assembly into an unlocked position.

Figure 7:
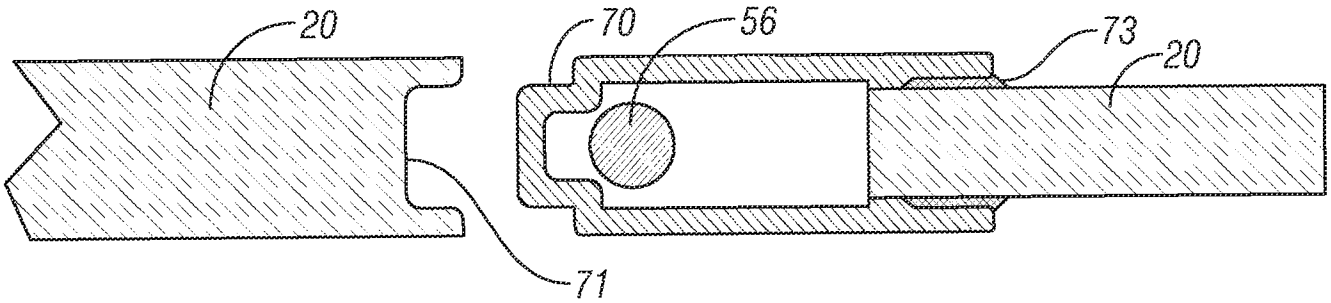
FIG. 7 is a cross-sectional view of an embodiment of a connector bar cover included in a door lock assembly and an adjacent door panel assembly in accordance with the present invention.

Connecting rod cover 60, or end cap, is an elongate body that has a generally U-shaped cross section, as shown in FIG. 7. Connecting rod cover 60 is coupled to an edge of door panel 20 adjacent connecting rod portion 64 of cutout 52. Cover 60 is sized so that engagement edge 70 is generally flush with engagement edge 68 of door panel 20 and engagement edge 66 of lock mechanism 54. Cover 60 may be clamped or bonded to door panel 20. Preferably, cover 60 is bonded to wall panel with an adhesive, such as silicone 73. Another method of attachment could include the use of Hi-Bond Acrylic tape.

It should be appreciated that a portion of door panel 20 received by cover 60 may have a reduced thickness, if desired. The reduced thickness allows the overall thickness of cover 60 to be reduced. In an embodiment, the overall thickness of cover 60 is generally identical to the maximum thickness of door panel 20 so that door panel lock assembly 12 does not increase the effective width of door panel assembly 14. In an exemplary embodiment, door panel 20 has a thickness of ¾" but is tapered down to a ½" portion that is received within a ¾" thick connector bar cover 60. The preferred embodiment would include ½" thick glass, thus eliminating the need for this reduced thickness.

In the present embodiment, engagement edge 70 of connecting rod cover 60 is stepped to form a male engagement structure. This stepped surface mechanically fills the slot in the end cap, which in normal door rail use, would be filled by the door or wall panel glass. This cover is clad with metal for finishes other than that of anodized aluminum.

Figure 5:
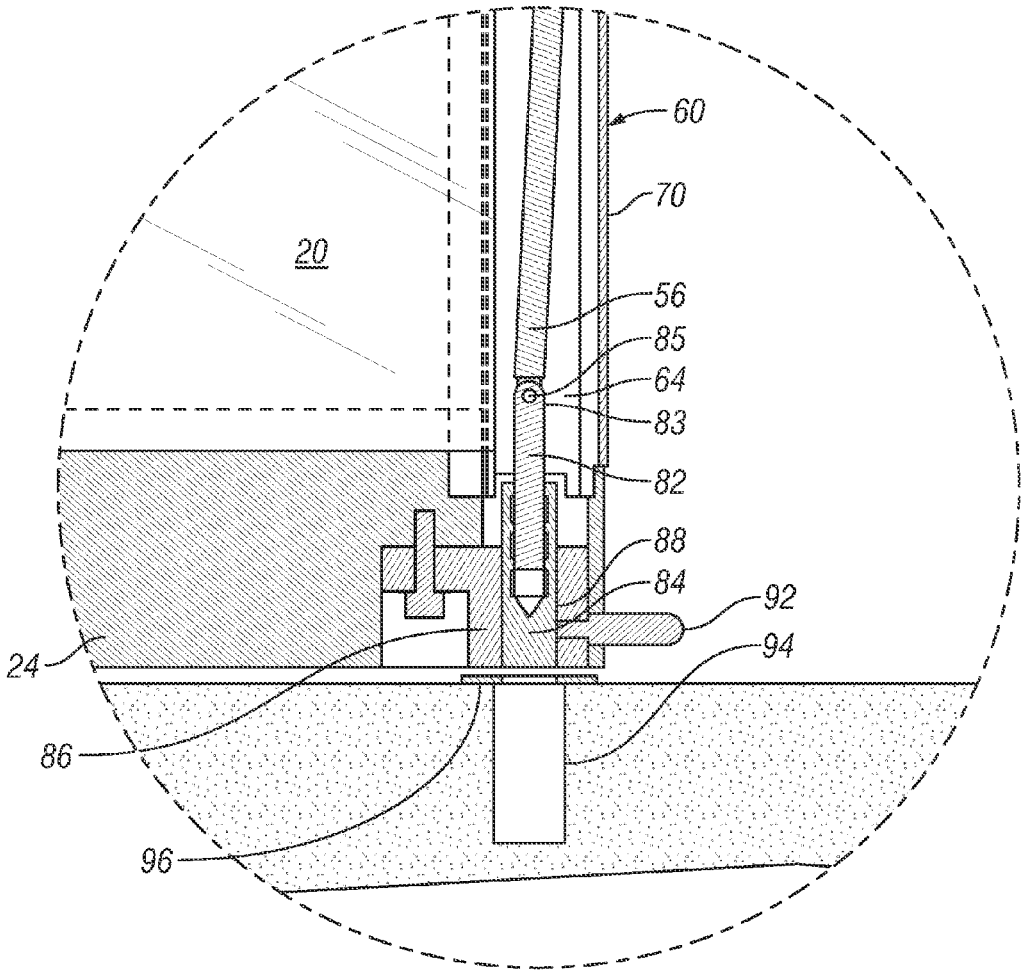
FIG. 5 is a detail view of a portion B of the door lock assembly of FIG. 1.
Figure 6:
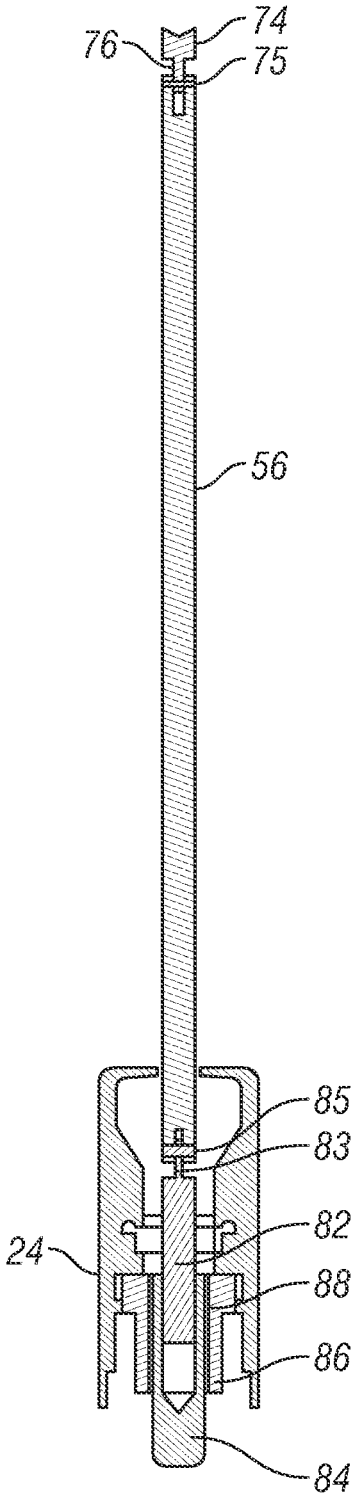
FIG. 6 is a cross-sectional end view of a portion of the door lock assembly of FIG. 1.

Referring now to FIGS. 2, 5 and 6, floor bolt assembly 58 is located at the bottom of door panel 20 generally below cutout 52. Floor bolt assembly 58 includes a push rod 82, a floor bolt 84 and a floor bolt housing 86. Push rod 82 includes a tab 83 that is configured to rotatably mount with connecting rod 56 at a lower end of connecting rod 56. In particular, tab 83 is inserted into a channel of connecting rod 56 and a pin 85, or other fastener, extends across the interface to form a rotatable connection.

Push rod 82 extends between connecting rod 56 and floor bolt 84. In the present embodiment, push rod 82 is coupled to floor bolt 84 by a threaded connection that allows the vertical position of floor bolt 84 to be adjusted. Both push rod 82 and floor bolt 84 are elongate bodies constructed from a rigid material, such as steel, aluminum or composite. It should be appreciated that floor bolt 84 is preferably constructed from a hardened material that is difficult to cut to prevent tampering.

Floor bolt housing 86 is coupled to lower rail 24 and provides a guide for floor bolt 84. In particular, floor bolt housing 86 includes a guide aperture 88 that is configured to slidably receive floor bolt 84. Floor bolt housing 86 also includes a mounting flange 90 that allows floor bolt housing 86 to be bolted directly to lower rail 24. It should be appreciated, however that floor bolt housing 86 may be coupled to lower rail 24 in any desired way. In addition, it should be appreciated that floor bolt housing 86 may be coupled to wall panel directly or to connecting rod cover 60 if desired.

An alignment pin 92 may also be included on wall panel assembly 14. Alignment pin 92 is protrusion that extends beyond the engagement edges of wall panel 20, lock mechanism 54 and cover 60. Alignment pin 92 is configured to be received by an alignment aperture in an adjacent wall panel to assure proper alignment of the wall panels when they are in a closed position.

In operation, a user swings door panel assembly 14 into a desired closed position. When door panel assembly 14 is in the closed position, the user activates lock mechanism 54 by turning a key or a thumb turn included on lock mechanism 54. Activation of lock mechanism 54 causes transfer arm 74 to translate downward. That translation causes connecting rod 56 and push rod 82 to also translate downward. Floor bolt 84 is coupled to the lower end of push rod 82 so that it also translates downward. A floor strike 94 with a locking cover 96 is provided below floor bolt 84 so that downward translation of floor bolt 84 results in floor bolt 84 engaging floor strike 94. Once floor bolt 84 engages floor strike 94 door panel assembly 14 is locked in place.

A floor pedal (not shown) may also be included in the assembly. The floor pedal may be used to directly activate the floor bolt assembly. For example, the floor pedal may be a linkage directly coupled to the connecting rod 56, push rod 82 and/or floor bolt 84 that allows a user to translate the floor bolt 84 into a locked position.

Figure 8:
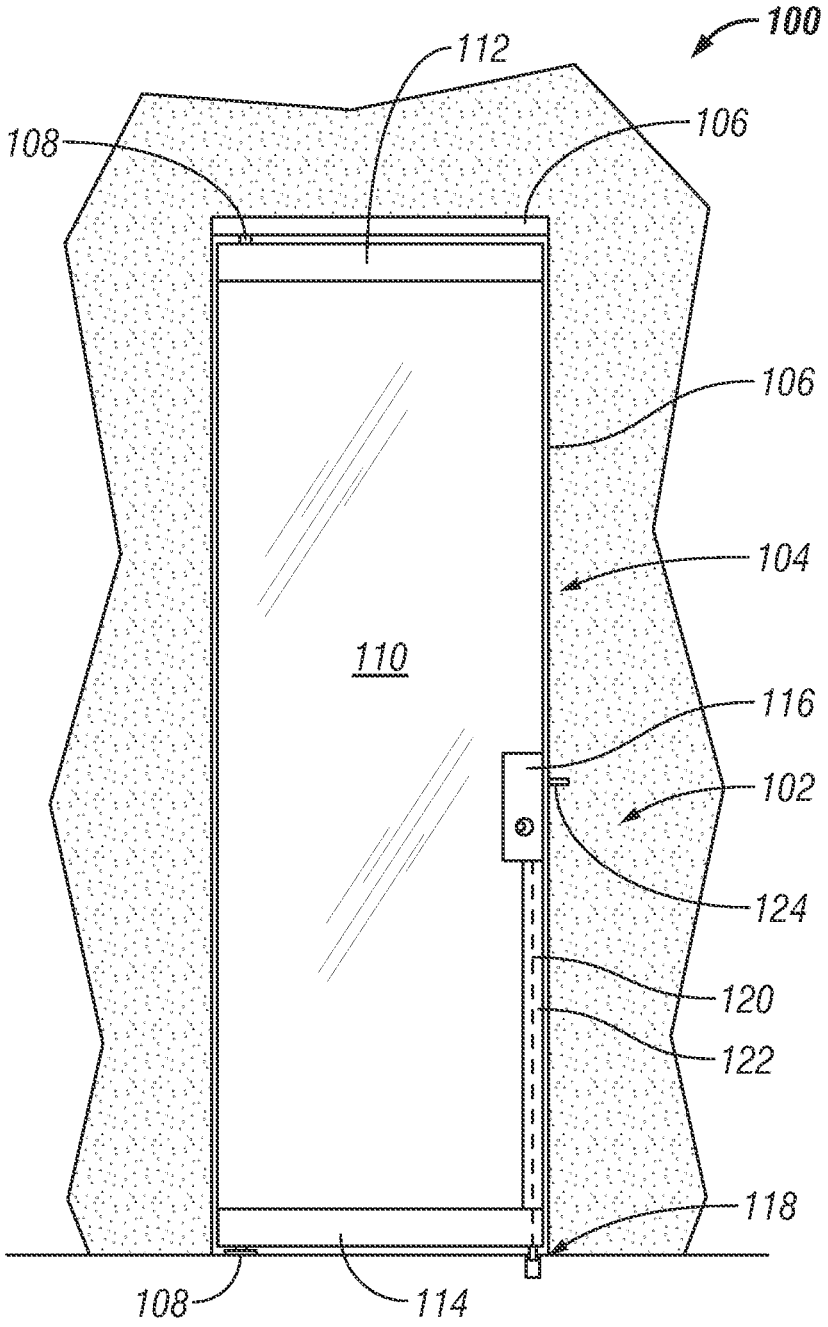
FIG. 8 is a side view of an exemplary embodiment of a swinging door system incorporating a door lock system in accordance with the present invention.

Referring to FIG. 8, a swinging single door panel system 100 incorporating a door panel lock assembly 102 will be described. In the illustrated embodiment, swinging panel system 100 incorporates a single pivoting wall panel assembly 104 mounted in a door frame 106. Door panel assembly 104 is mounted on a pivot assembly 108 so that one side is hinged, thereby allowing it to swing between an open position and a closed position. It should be appreciated that any pivot assembly may be used to mount door panel assembly 104 in door frame 106.

Similar to the embodiments described above, wall panel assembly 104 is generally constructed from a wall panel 110, an upper rail 112, a lower rail 114 and panel lock assembly 102. Wall panel 110 is constructed so that it forms a physical barrier partition when it is suspended between upper rail 112 and lower rail 114. Wall panel 110 may be constructed from any material such as glass, wood, metal, composites or any combination thereof. In a preferred embodiment, wall panel 110 is constructed of tempered glass so that it provides a transparent physical barrier.

Door panel lock assembly 102 includes a structure generally identical to that shown in FIG. 2. Door panel lock assembly 102 includes main lock mechanism 116 that is mechanically coupled to a floor bolt assembly 118 via a connecting rod 120, and connecting rod cover 122. Main lock mechanism 116 may be a two point lock mechanism and may include an optional side locking bolt 124, if desired, in addition to floor bolt assembly 118. Lock mechanism 116 is preferably keyed, but it should be appreciated that it may also include any standard lock, thumb turn and/or dummy cylinder.

Activation of lock mechanism 116 causes a connecting rod to translate vertically, which activates floor bolt assembly and locks or unlocks wall panel assembly 14. Activation of lock mechanism 116 simultaneously activates side-locking bolt 124, which engages a strike in a vertical wall of door frame 106. It should be appreciated that the configuration shown in FIG. 8 may also be utilized in embodiments utilizing a pair of swinging doors, as shown in FIG. 1, or a door that engages a sidelite panel.

Figure 9:
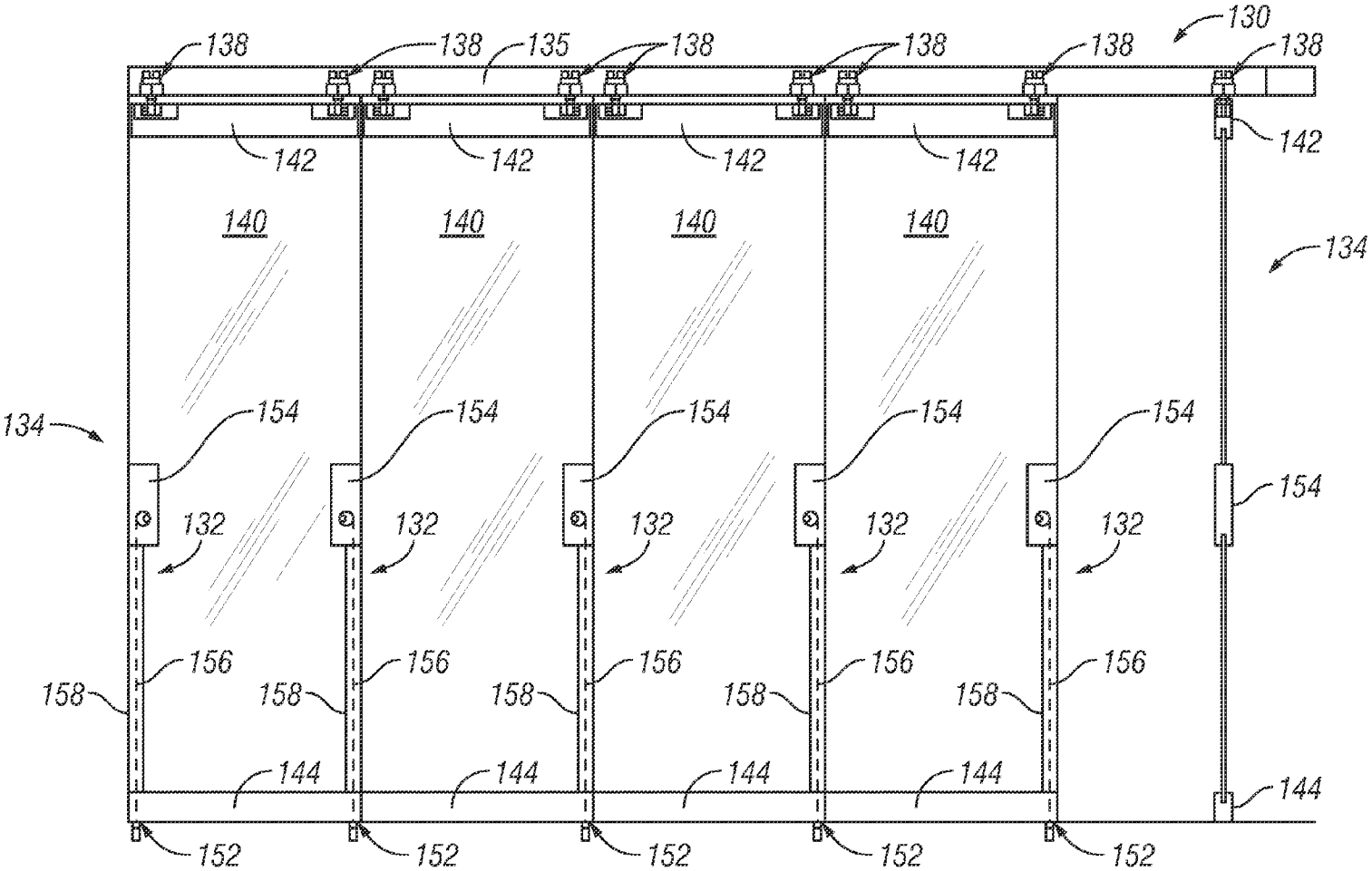
FIG. 9 is a side view of an exemplary embodiment of a wall panel system incorporating a door lock system in accordance with the present invention.
Figure 10:
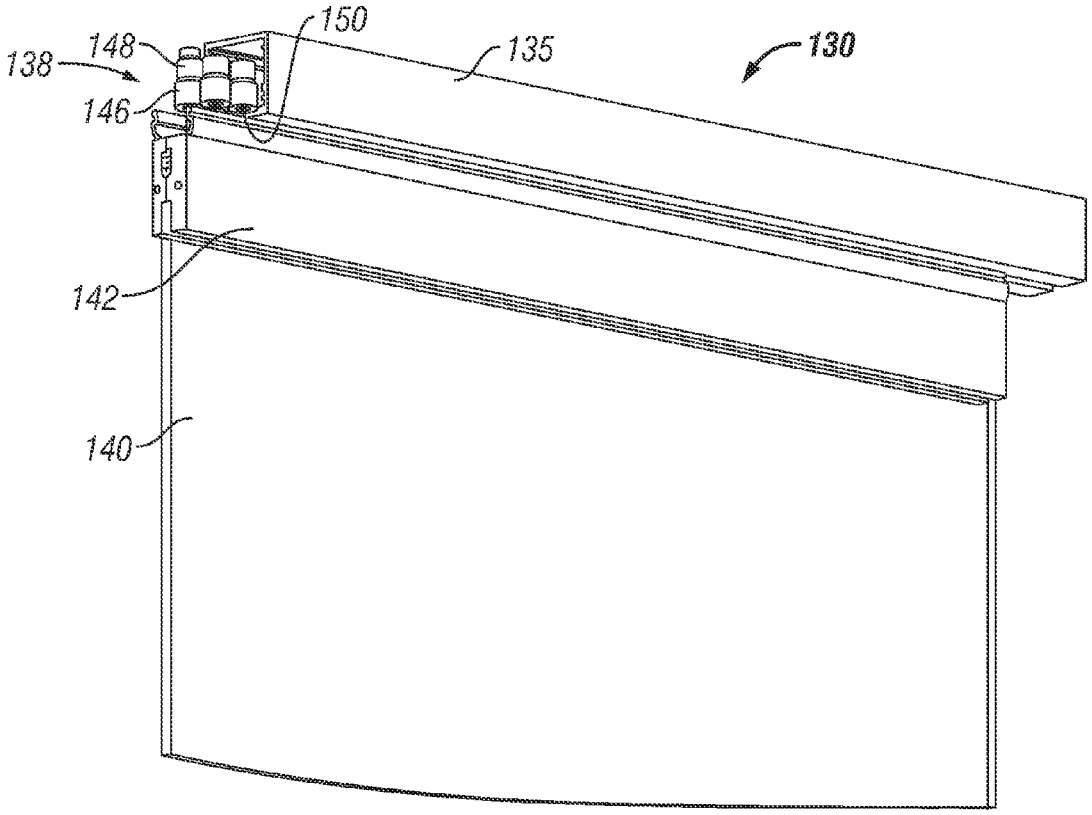
FIG. 10 is a perspective view of a portion of the wall panel system of FIG. 9.
Figure 11:
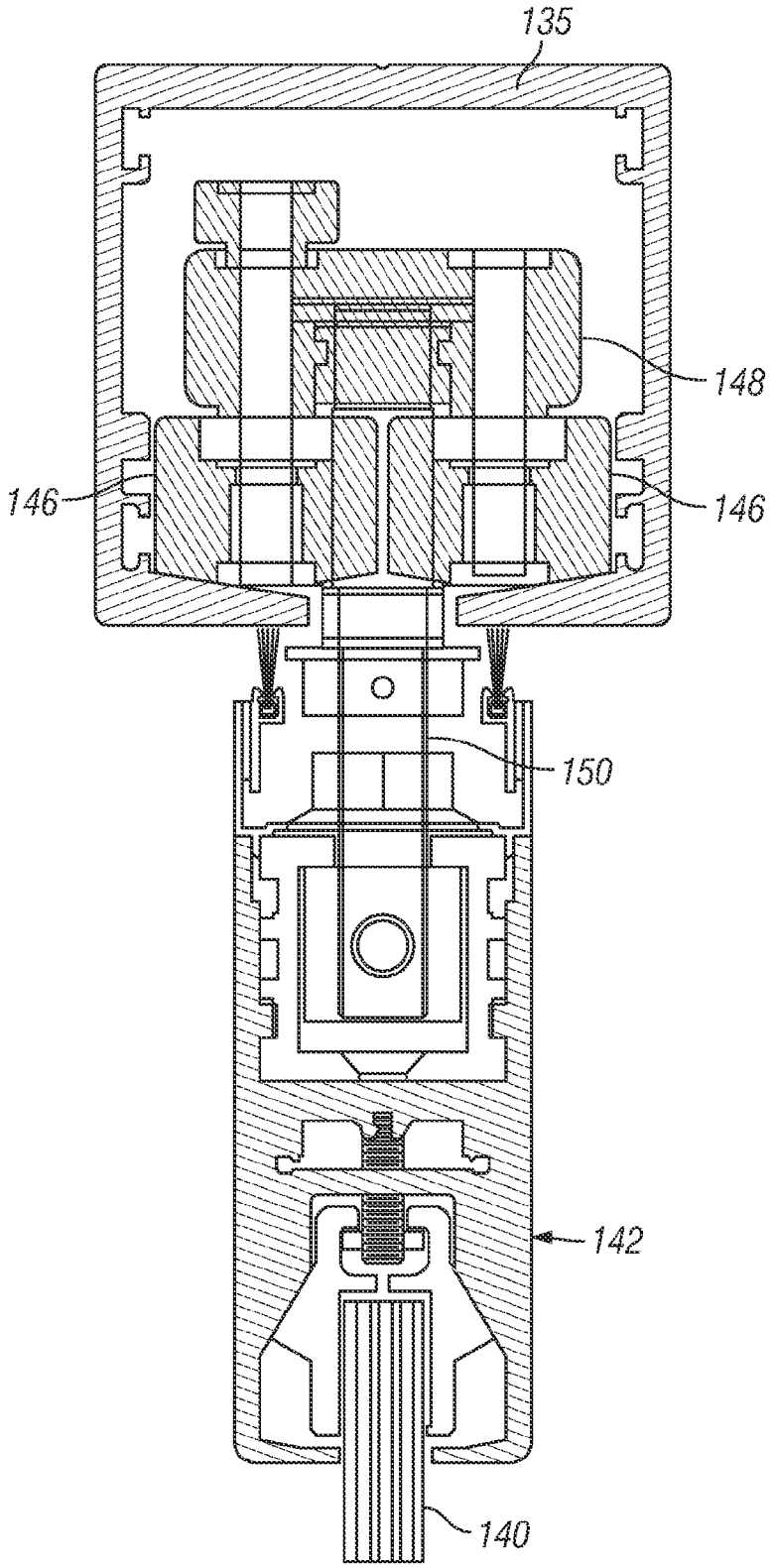
FIG. 11 is a cross-sectional view of a portion of the wall panel system of FIG. 9.

Referring to FIGS. 9-11, an exemplary embodiment of a wall panel system 130 is described in which the panel lock assembly of the present invention is utilized. Wall panel system 130, generally includes a plurality of individual wall panel assemblies 134 that are independently suspended from a track 135 mounted in a door frame, or opening, by a plurality of trolleys 138. Each wall panel assembly 134 includes at least one panel lock assembly 132 so that wall panel 134 may be locked in a closed position.

Wall panel assembly 134 is generally constructed from a wall panel 140, an upper rail 142, a lower rail 144 and panel lock assembly 132. Wall panel 140 is constructed so that it forms a partition when suspended by track 135. Wall panel 140 may be constructed from any material such as glass, wood, metal, composites or any combination thereof. In a preferred embodiment, wall panel 140 is constructed of tempered glass so that it provides a transparent physical barrier which may be especially desirable for a mall store front application.

An upper portion of wall panel 140 extends into a channel included in upper rail 142. A trolley mounting feature provides a location for mechanically coupling trolley 138 to upper rail 142. Upper rail 142 is mechanically coupled to wall panel 140 so that wall panel assembly 134 may be suspended from track 135.

Similarly, a lower portion of wall panel 140 extends into a channel included in lower rail 144. Lower rail 144 is also mechanically coupled to wall panel 140 so that wall panel 140 and lower rail 144 may be suspended from track 135. In the present embodiment, lower rail 144 is suspended but it should be appreciated that rollers may be coupled to lower rail 144 if desired. The rails are generally constructed identical to those described above and will not be further described.

Track 135 is used to define the path of wall panel assemblies 134 of wall panel system 130. Track 135 is generally an elongate tubular member that includes a channel extending from the interior to the exterior of the tubular member.

Trolley 138 is configured to provide a rotating and translating interface between wall panel assembly 134 and track 135. Trolley 138 generally comprises a housing 148 that supports four main rollers 146 that rotate about vertical axes and pendant bolt 150. Pendant bolt 150 couples wall panel assembly 134 to trolley 148. Rollers 146 are configured to roll within track 135 so that wall panel assembly 134 may be translated.

Wall panel system 130 employs a plurality of wall panel assemblies 134, each of which is supported by two trolleys 138 engaged with track 135. Each wall panel assembly 134 is independent of the others so that each may be separately translated and rotated from a closed position, in which wall panel assemblies 134 are serially aligned, as shown in FIG. 9, to form a physical barrier, and an open position, in which wall panel assemblies 134 are in a generally stacked configuration.

In the present embodiment, each wall panel assembly 134 includes at least one panel lock assembly 132. Similar to the above-described embodiments, each panel lock assembly 132 is installed in a cutout and includes a main lock mechanism 154 that is mechanically coupled to a floor bolt assembly 152 via a connecting member 156, and a cover 158. Wall panel lock assembly 132 is generally identical to the door panel lock assemblies described above, and therefore will not be again described in detail. It should be appreciated that more than one panel lock assembly 132 may be incorporated into one or more wall panel assemblies 134 if desired, as shown. Each side of wall panel assembly 134 may include panel lock assembly for further security.

It should further be appreciated that a handle may be incorporated onto any of the door panel assemblies. Preferably, a handle assembly is included in swinging embodiments, but not included in stacking wall systems so that the handle does not hinder the ability to stack the plurality of wall panel assemblies. It should also be appreciated that panic handles or crash bars may also be included if desired to activate the corresponding main lock mechanism.

Thus, it is seen that a door panel lock system and method of use are provided. One skilled in the art will appreciate that the present invention can be practiced by other than the preferred embodiments which are presented in this description for purposes of illustration and not of limitation, and the present invention is limited only by the claims that follow. It is noted that equivalents for the particular embodiments discussed in this description may practice the invention as well.

What is claimed is:

1. A door panel assembly, comprising:

a door panel including:

a top edge and a bottom edge opposite the top edge;

a hinge side and a locking side opposite the hinge side, the locking side including a substantially longitudinal edge;

a first face extending between the hinge side and locking side, and a second face opposite the first face and extending between the hinge side and locking side;

a first cutout portion in the locking side, positioned between the top and bottom edges, the first cutout portion having a first lateral depth displaced from the longitudinal edge;

a second cutout portion in the locking side, positioned between the first cutout portion and the bottom edge, the second cutout portion having a second lateral depth displaced from the longitudinal edge, the second lateral depth being different from the first lateral depth;

a locking assembly coupled to the door panel in the first cutout portion, the locking assembly including a locking actuation mechanism accessible from at least one of the first face or second face;

a bolt assembly vertically displaced from the locking assembly and positioned between the first cutout and the bottom edge, the bolt assembly including an extendible bolt and a hinge;

an elongated connecting member extending within the second cutout portion and extending between the locking assembly and the bolt, the elongated member being pivotally connected to the locking assembly and the bolt, the connecting member transmitting translation motion provided by operation of the locking mechanism to the bolt, between an extended locked position in which at least a portion of the bolt extends beneath the bottom edge and a retracted unlocked position; and a connecting member cover coupled to the door panel and covering at least a portion of the connecting member and the second cutout portion, the second cutout portion enclosed by the connecting member cover defining a connecting member channel, a longitudinal edge of the connecting member channel being substantially flush with the longitudinal edge.

2. The door panel assembly of claim 1, further comprising a lower rail coupled to the bottom edge of the door panel.

3. The door panel assembly of claim 2, further comprising an upper rail coupled to the top edge of the door panel.

4. The door panel assembly of claim 3, wherein the upper rail includes a trolley connection.

5. The door panel assembly of claim 3, wherein the upper rail includes a pivot connection.

6. The door panel assembly of claim 1, wherein the connecting member cover defines a second longitudinal edge that is substantially coplanar with the first longitudinal edge, defining a lateral width at the second longitudinal edge that is substantially the same as the lateral width of the door panel in the first linear portion.

7. The door panel assembly of claim 1, wherein the locking mechanism includes a side locking bolt.

8. The door panel assembly of claim 1, wherein the connecting member cover includes a stepped engagement edge corresponding to the width dimensions defined in the first and second cutout portions.

9. The door panel assembly of claim 1, wherein the door panel is transparent.

10. The door panel assembly of claim 1, wherein the connecting member is a rigid connecting rod.

11. A swinging door system, comprising at least one door panel assembly as recited in claim 1, and a pivot assembly wherein the door panel assembly is pivotally coupled to the pivot assembly so that it is configured to swing between an open position and a closed position.

12. The swinging door system of claim 11, wherein the cover includes a stepped engagement edge corresponding to the width dimensions defined in the first and second cutout portions.

13. The swinging door system of claim 11, wherein a door panel assembly includes a male engagement structure configured to engage a female engagement structure of an adjacent door panel assembly.

14. The swinging door system of claim 11, wherein the connecting member is a rigid connecting rod.

15. The door panel assembly of claim 1 further defining stress relief features in the stepped cutout.

16. The door panel assembly of claim 15 wherein the stress relief features are through holes at interior corners of the first portion of the stepped cutout.

17. The door panel assembly of claim 1, wherein the locking assembly includes an alignment pin extending beyond the substantially longitudinal edge of the locking side, wherein the alignment pin is received within an alignment aperture in an adjacent door panel.

18. A wall panel system comprising:

an elongate track;

a plurality of trolleys translatable in the elongate direction relative to the elongate track; and a plurality of wall panel assemblies each coupled to at least one of said trolleys and translatable relative to the track, wherein at least one of the wall panel assemblies includes:

a wall panel including:

a top edge adjacent the track and a bottom edge opposite the top edge;

a hinge side and a locking side opposite the hinge side, the locking side including a substantially longitudinal edge;

a first face extending between the hinge side and locking side, and a second face opposite the first face and extending between the hinge side and locking side;

a first cutout portion having a first lateral depth displaced from the longitudinal edge;

a second cutout portion in the locking side, positioned between the first cutout portion and the bottom edge, the second cutout portion having a second lateral depth displaced from the longitudinal edge, the second lateral depth being different form the first lateral depth;

a locking, assembly coupled to the wall panel in the first cutout portion;

a bolt assembly vertically displaced from the locking assembly and positioned between the first cutout and the bottom edge, the bolt assembly including an extendible bolt and a hinge;

an elongated connecting member extending within the second cutout portion and extending between the locking assembly and the bolt, the elongated member being pivotally connected to the locking assembly and the bolt, the connecting member transmitting translation motion provided by operation of the locking mechanism to the bolt, between an extended locked position in which at least a portion of the bolt extends beneath the bottom edge and a retracted unlocked position; and a connecting member coupled to the wall panel and covering at least a portion of the connecting member and the second mom portion, the second cutout portion enclosed by the connecting member cover defining a connecting member channel, a longitudinal edge of the connecting member channel being substantially flush with the longitudinal edge.

19. The wall panel system of claim 18, wherein each panel assembly includes an upper region and is coupled to a plurality of trolleys in the upper region.

20. The wall panel system of claim 18, wherein each wall panel assembly is suspended from the track by the at least one of the trollies connected to it.

21. The wall panel system of claim 18, wherein the cover includes a stepped engagement edge.

22. The wall panel system of claim 18, wherein a wall panel assembly includes a male engagement structure configured to engage a female engagement structure of an adjacent wall panel assembly.

23. The wall panel system of claim 18, wherein the connecting member is a rigid connecting rod.

24. The wall panel system of claim 18, wherein the wall panel includes an alignment pin extending beyond the substantially longitudinal edge of the locking side, wherein the alignment pin is received within an alignment aperture in an adjacent wall panel.

* * * * *